US009696677B2

(12) United States Patent
Wada

(10) Patent No.: US 9,696,677 B2
(45) Date of Patent: Jul. 4, 2017

(54) SHEET CONVEYANCE APPARATUS THAT ENSURES GROUNDING OF DISCHARGING MEMBER AND CONVEYANCE ROLLER WITH SIMPLE CONFIGURATION, AND IMAGE FORMING APPARATUS INCLUDING THE SAME

(71) Applicant: Kyocera Document Solutions Inc., Osaka (JP)

(72) Inventor: Hiroshi Wada, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/233,526

(22) Filed: Aug. 10, 2016

(65) Prior Publication Data

US 2017/0045852 A1 Feb. 16, 2017

(30) Foreign Application Priority Data

Aug. 10, 2015 (JP) ..... 2015-158166

(51) Int. Cl.
*B65H 5/06* (2006.01)
*B65H 31/00* (2006.01)
(Continued)

(52) U.S. Cl.
CPC ..... *G03G 15/6529* (2013.01); *B65H 5/062* (2013.01); *B65H 29/125* (2013.01);
(Continued)

(58) Field of Classification Search
CPC .... B65H 2301/5133; B65H 2301/5321; B65H 5/06; B65H 29/125; B65H 31/00; B65H 31/26
See application file for complete search history.

(56) References Cited

U.S. PATENT DOCUMENTS 4,951,935 A * 8/1990 Oikawa ..... B65H 29/52 271/208
5,478,061 A * 12/1995 Murakami ..... G03G 15/6573 270/58.08

(Continued)

FOREIGN PATENT DOCUMENTS

JP 2001233489 A * 8/2001
JP 2001-315401 A 11/2001

(Continued)

*Primary Examiner* — Luis A Gonzalez
(74) *Attorney, Agent, or Firm* — James Judge

(57) ABSTRACT

A sheet conveyance apparatus includes a housing, a rotationally driven conductive shaft, a conveyance roller, a drive transmission unit, a conductive bearing member, a conductive discharging member, a cover member, and a conductive grounding member. The bearing member rotatably supports one end side of a shaft in a sheet width direction. The conductive discharging member is disposed in the openings. The discharging member discharges sheets by contacting the sheets. The cover member is secured to the sidewall along the one end side of the housing in the sheet width direction. The cover member includes a conductive grounding portion for electrical grounding. The conductive grounding member contacts the bearing member and the one end side of the discharging member along the sheet width direction. The grounding member conducts the bearing member and the discharging member to the grounding portion of the cover member.

8 Claims, 14 Drawing Sheets

(51) Int. Cl.
*B65H 29/12* (2006.01)
*G03G 15/00* (2006.01)

(52) U.S. Cl.
CPC ..... *B65H 2301/5133* (2013.01); *B65H 2301/5321* (2013.01); *B65H 2401/211* (2013.01); *B65H 2404/186* (2013.01); *B65H 2801/06* (2013.01); *G03G 2215/00679* (2013.01)

(56) References Cited

U.S. PATENT DOCUMENTS

| | | | | |
|---|---|---|---|---|
| 7,661,884 | B2 * | 2/2010 | Jo | F16C 13/02 361/221 |
| 7,846,279 | B2 * | 12/2010 | Oh | B65H 37/00 156/293 |
| 8,682,238 | B2 * | 3/2014 | Okamura | B65H 3/06 399/381 |
| 2009/0108518 | A1 * | 4/2009 | Kawashima | B65H 5/36 271/225 |

FOREIGN PATENT DOCUMENTS

| | | | | |
|---|---|---|---|---|
| JP | 2002-226074 | A | | 8/2002 |
| JP | 2008156108 | A | * | 7/2008 |
| JP | 2013068750 | A | * | 4/2013 |

* cited by examiner

SHEET CONVEYANCE APPARATUS THAT ENSURES GROUNDING OF DISCHARGING MEMBER AND CONVEYANCE ROLLER WITH SIMPLE CONFIGURATION, AND IMAGE FORMING APPARATUS INCLUDING THE SAME

INCORPORATION BY REFERENCE

This application is based upon, and claims the benefit of priority from, corresponding Japanese Patent Application No. 2015-158166 filed in the Japan Patent Office on Aug. 10, 2015, the entire contents of which are incorporated herein by reference.

BACKGROUND

Unless otherwise indicated herein, the description in this section is not prior art to the claims in this application and is not admitted to be prior art by inclusion in this section.

A typical sheet conveyance apparatus, which conveys sheets, includes a brush-shaped discharging member for contacting the sheet. The discharging member discharges electric charge of the sheets, and this stabilizes conveyability and loadability of the sheets. There is proposed a grounding mechanism that grounds a conveyance roller.

SUMMARY

A sheet conveyance apparatus according to one aspect of the disclosure includes a housing, a rotationally driven conductive shaft, a conveyance roller, a drive transmission unit, a conductive bearing member, a conductive discharging member, a cover member, and a conductive grounding member. The housing includes openings through which sheets conveyed in a predetermined direction pass, and a pair of sidewalls. The housing is made of a resin material. The sidewalls are located at both end portions of the housing in a sheet width direction intersecting with a conveyance direction of the sheet. The rotationally driven conductive shaft extends in the sheet width direction in the housing. The conveyance roller is secured to the shaft. The conveyance roller rotates to convey sheets for passing through the openings in association with the shaft rotating. The drive transmission unit is provided on one of the pair of the sidewalls along one end side in the sheet width direction. The drive transmission unit transmits rotary drive power to the shaft. The conductive bearing member is installed in the housing. The bearing member rotatably supports the one end side of the shaft in the sheet width direction. The conductive discharging member is disposed in the openings. The discharging member discharges sheets by contacting the sheets. The cover member is secured to the one of the pair of sidewalls along the one end side of the housing in the sheet width direction. The cover member covers the drive transmission unit. The cover member includes a conductive grounding portion for electrical grounding. The conductive grounding member contacts the bearing member and the one end side of the discharging member along the sheet width direction. The grounding member conducts the bearing member and the discharging member to the grounding portion of the cover member.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
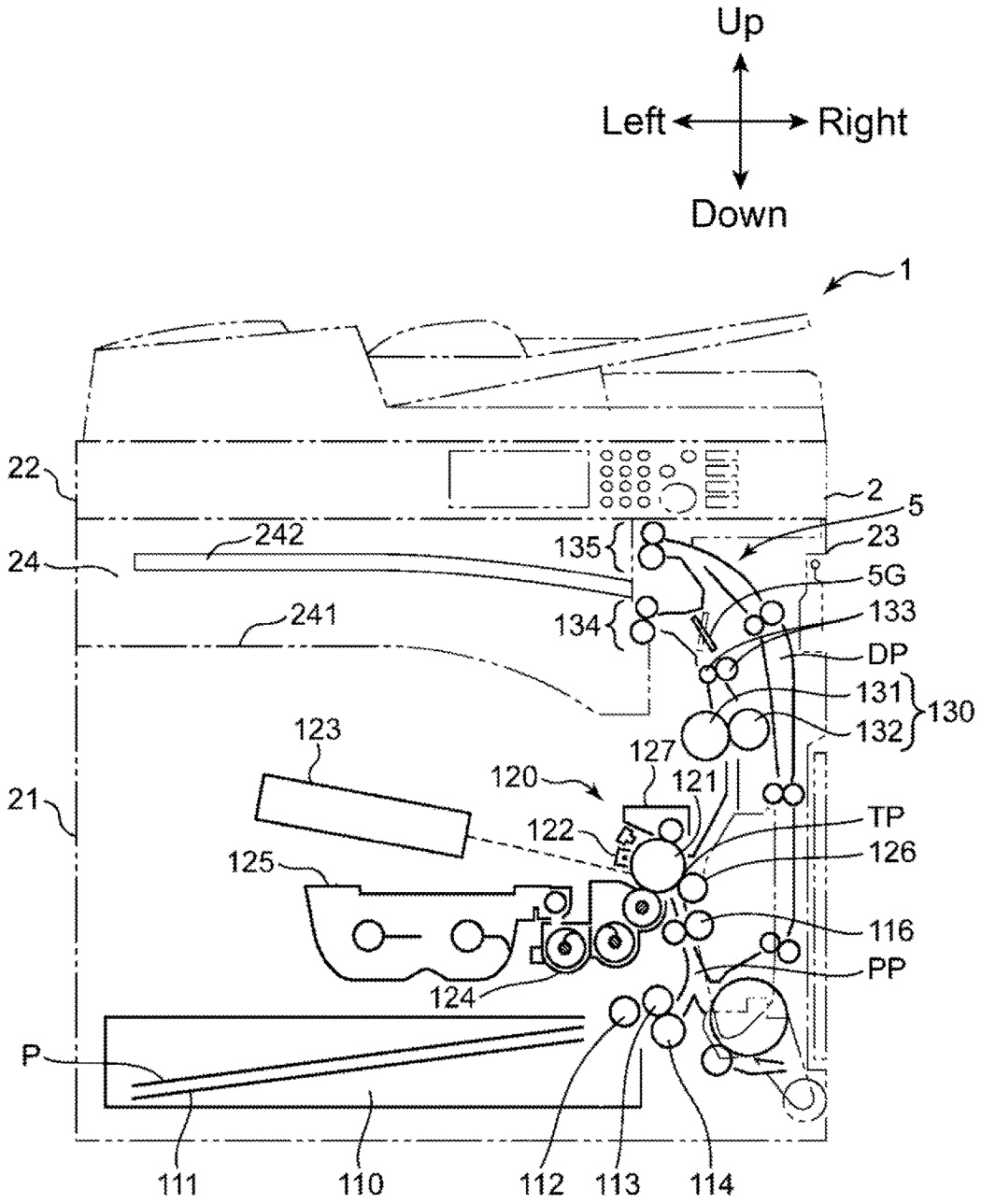
FIG. 1 illustrates a cross section of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes one embodiment of the disclosure with reference to the drawings. FIG. 1 illustrates an internal cross section of an image forming apparatus 1 according to the one embodiment of the disclosure. While the image forming apparatus 1 illustrated in FIG. 1 is, what is called, a black-and-white printer, the image forming apparatus may be a color printer, a facsimile device, a multi-functional peripheral that includes these functions, and other devices for forming a toner image on a sheet in another embodiment. In the following description, directional terms like "up," "down," "front," "rear," "left," and "right" are simply used for clarifying the description without limiting principles of the image forming apparatus. The term of "sheet" in the following description means a copy paper, a coated paper, an OHP sheet, a cardboard, a postcard, a tracing paper, another sheet material on which an image formation process is executed, or a sheet material on which any process other than the image formation process is executed.

The image forming apparatus 1 includes a main chassis 2, which has an approximately rectangular parallelepiped shape. The main chassis 2 includes a lower chassis 21, an upper chassis 22, and a connection chassis 23. The lower chassis 21 has an approximately rectangular parallelepiped shape. The upper chassis 22 is located over the lower chassis 21, and has an approximately rectangular parallelepiped shape. The connection chassis 23 connects the lower chassis 21 to the upper chassis 22. The connection chassis 23 extends along a right edge and a back-side edge of the main chassis 2. A discharge space 24 is a space surrounded by the lower chassis 21, the upper chassis 22, and the connection chassis 23. A sheet on which a printing process is executed is discharged to the discharge space 24. Especially in the embodiment, the sheet is discharged to a paper sheet discharge unit 241, which is located at a top surface portion of the lower chassis 21, or a sheet discharge tray 242, which is located over the paper sheet discharge unit 241. The upper chassis 22 internally houses, mainly a device for reading an image of an original document and an electronic circuit that manages the whole control of the image forming apparatus 1.

The image forming apparatus 1 includes a sheet feed cassette 110, a pickup roller 112, a feed roller 113, a retard roller 114, and, an image forming unit 120.

The sheet feed cassette 110 internally houses sheets P. The sheet feed cassette 110 is drawable in a front direction (a near side direction of a paper surface in FIG. 1) from the lower chassis 21. The sheets P housed in the sheet feed cassette 110 are conveyed to an upper side in the lower chassis 21. After that, an image formation process is executed on the sheets P in the lower chassis 21, and then discharged to the discharge space 24. The sheet feed cassette 110 includes a lift plate 111 that supports the sheet P. The lift plate 111 is inclined so as to push up a leading edge of the sheet P to an upper side.

The pickup roller 112 is located above the leading edge of the sheets P, which are pushed up to the upper side by the lift plate 111, and conveys the sheets P. The feed roller 113 is locate at a downstream side in a sheet conveyance direction of the pickup roller 112, and conveys the sheets P to a further downstream side in the sheet conveyance direction. The feed roller 113 carries the sheets P into a sheet conveyance path PP. The sheet conveyance path PP is a conveyance path configured such that the sheet P conveyed from the sheet feed cassette 110 passes a transfer position TP located in the image forming unit 120. The retard roller 114 is located opposed to the feed roller 113, and has a function that handles a plurality of sheets P.

A registration roller pair 116 defines a position of the sheet in a direction orthogonal to the sheet conveyance direction. This adjusts a position of an image to be formed on the sheet P. The registration roller pair 116 conveys the sheet P to the image forming unit 120 in accordance with a transfer timing of a toner image on the sheet P in the image forming unit 120. The registration roller pair 116 has a function that corrects a skew of the sheet P.

The image forming unit 120 includes a photoreceptor drum 121, a charger 122, an exposure apparatus 123, a developing device 124, a toner container 125, a transfer roller 126 and, a cleaning apparatus 127.

The image forming apparatus 1 further includes a fixing unit 130 that fixes the toner image on the sheet P. The fixing unit 130 is located downstream in a conveyance direction with respect to the image forming unit 120. The fixing unit 130 includes a heating roller 131 and a pressure roller 132. The heating roller 131 melts the toner on the sheet P. The pressure roller 132 causes the sheet P to closely contact the heating roller 131. After the sheet P passes between the heating roller 131 and the pressure roller 132, the toner image is fixed on the sheet P. The fixing unit 130 includes a fixing conveyance roller pair 133. The fixing conveyance roller pair 133 conveys the sheet P, on which a fixing process has been performed, to a downstream side in the sheet conveyance direction.

The image forming apparatus 1 includes a sheet discharge unit 5 located at a downstream of the fixing unit 130. The sheet discharge unit 5 discharges the sheet P to the discharge space 24. The sheet discharge unit 5 includes a switch guide 5G located at a downstream of the fixing conveyance roller pair 133, a lower discharge roller pair 134, and an upper discharge roller pair 135.

The switch guide 5G has a function of switching a conveyance direction of the sheet P at the downstream side in a sheet conveyance direction of the fixing conveyance roller pair 133. The lower discharge roller pair 134 is located at a left side of the switch guide 5G, and discharges the sheet P conveyed by the fixing conveyance roller pair 133 to the paper sheet discharge unit 241. The upper discharge roller pair 135 is located above the lower discharge roller pair 134, and discharges the sheet P conveyed by the fixing conveyance roller pair 133 to the sheet discharge tray 242, which is installed above the paper sheet discharge unit 241.

Figure 2:
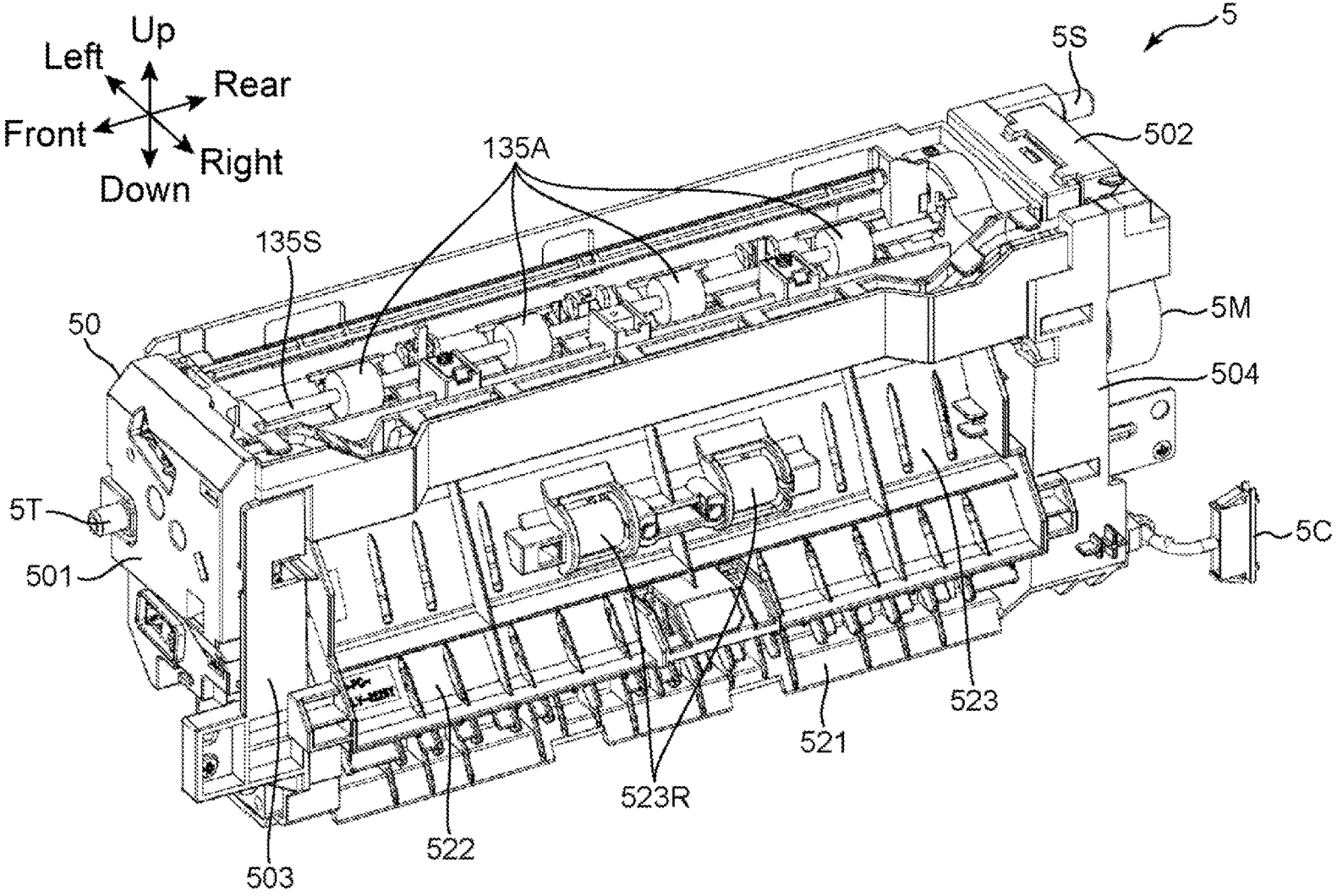
FIG. 2 obliquely illustrates a sheet conveyance apparatus according to the one embodiment.
Figure 3:
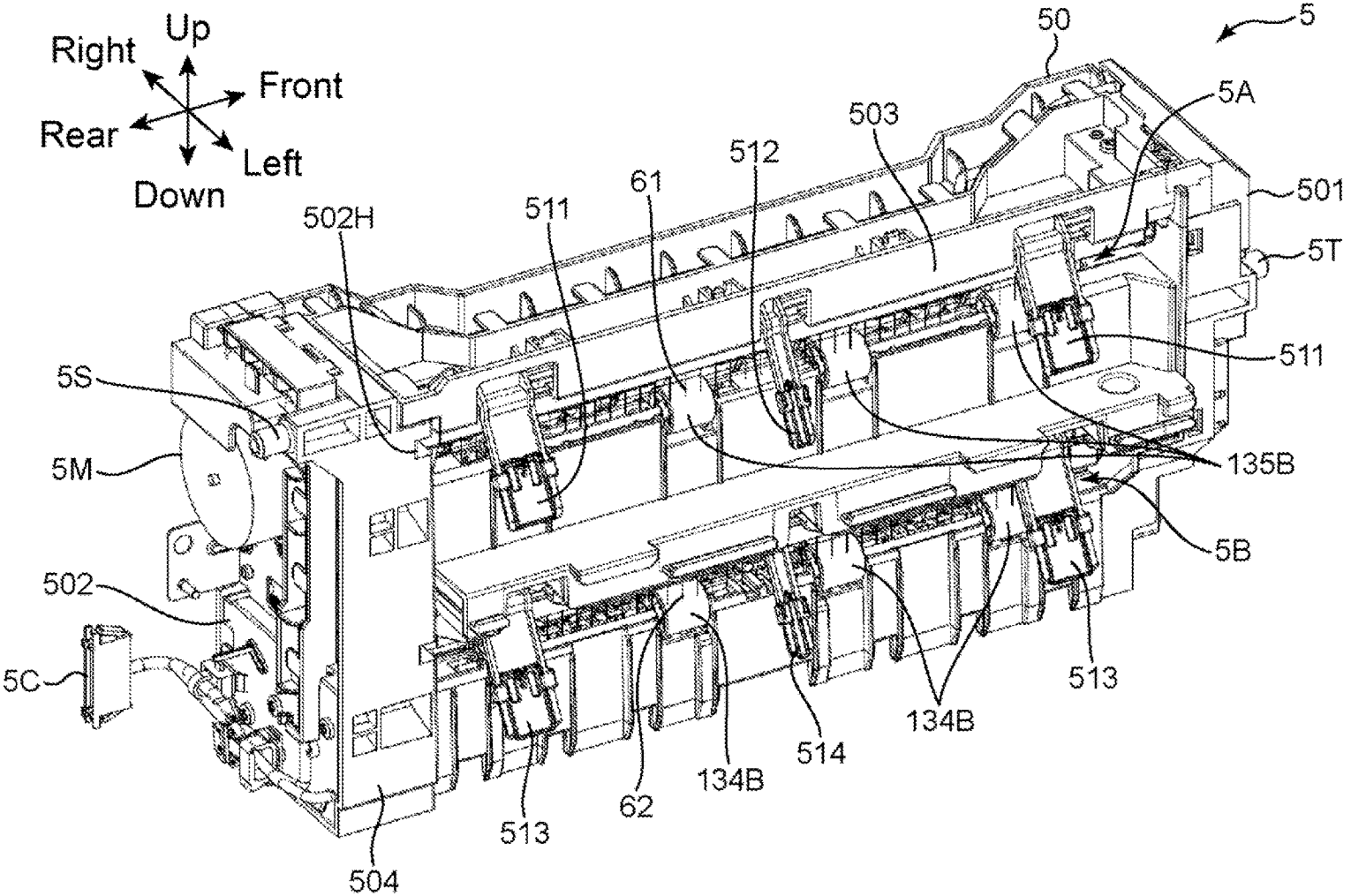
FIG. 3 obliquely illustrates the sheet conveyance apparatus according to the one embodiment.

Next, the following further describes the sheet discharge unit 5 (a sheet conveyance apparatus) according to the embodiment in detail. FIGS. 2 and 3 obliquely illustrate the sheet discharge unit 5 according to the embodiment. The sheet discharge unit 5 is removably attachable with respect to the connection chassis 23. The sheet discharge unit 5 is a unit having an approximately rectangular parallelepiped shape. The sheet discharge unit 5 includes a unit housing 50. The unit housing 50 includes a front cover 501, a sheet metal cover 502 (a cover member), and a main body housing 503 (a housing).

The main body housing 503 is a housing that supports respective members of the sheet discharge unit 5. In the embodiment, the main body housing 503 is made of a resin material, and has a box shape. The main body housing 503 includes an upper discharge port 5A (an opening) and a lower discharge port 5B (see FIG. 3). The upper discharge port 5A and the lower discharge port 5B are openings that open in a left side surface of the main body housing 503. The upper discharge port 5A is passed by the sheet P conveyed leftward by the upper discharge roller pair 135 (see FIG. 1). Similarly, the lower discharge port 5B is passed by the sheet P conveyed leftward by the lower discharge roller pair 134 (see FIG. 1). The main body housing 503 includes a rear inner wall portion 504. The rear inner wall portion 504 constitutes a rear side surface of the main body housing 503.

The front cover 501 is installed at a front surface of the main body housing 503. In the embodiment, the front cover 501 is made of a resin material. The sheet metal cover 502 is fastened to the rear inner wall portion 504 of the main body housing 503 by a plurality of screws. The front cover 501 and the rear inner wall portion 504 constitute a sidewall of the housing of the disclosure. The front cover 501 and the rear inner wall portion 504 are located at both the end portions in a sheet width direction in the main body housing 503. The sheet metal cover 502 is a plate-shaped plate, and supports a motor 5M and a connector 5C, which will be described later. The sheet metal cover 502 is grounded via a conduction route (not illustrated) located in the connection chassis 23. In the embodiment, the entire sheet metal cover 502 functions as a grounding portion. With reference to FIG. 3, the rear inner wall portion 504 includes a cutout portion 502H. The cutout portion 502H is a cutout portion, in which the end edge contacting the upper discharge port 5A is partially cut out in a rectangular shape in the rear inner wall portion 504.

At a rear of the cutout portion 502H, a stud 5S is disposed as a column-shaped protrusion projecting rearward from a corner portion at a left end side and upper end side in the rear inner wall portion 504. As illustrated in FIGS. 2 and 3, a stud 5T is disposed to project similarly to the stud 5S, also at a front cover 501 side in the unit housing 50. When the sheet discharge unit 5 is installed toward a left side from a right side of the connection chassis 23 (see FIG. 1), the sheet discharge unit 5 is installed while the studs 5S and 5T are guided by a guide groove (not illustrated) included in the connection chassis 23.

The sheet discharge unit 5 further includes the motor 5M and the connector 5C. The motor 5M is a motor supported by the sheet metal cover 502. The motor 5M generates a rotary drive power transmitted to the upper discharge roller pair 135, the lower discharge roller pair 134, and another drive member. The connector 5C is a connector included in the sheet metal cover 502. After the sheet discharge unit 5 is installed in the connection chassis 23, the connector 5C is connected to a connector connecting portion (not illustrated). This ensures inputs of a driving voltage and a control signal to the sheet discharge unit 5.

With reference to FIG. 2, the sheet discharge unit 5 has a top surface portion that includes a first roller shaft 135S (a shaft) and a plurality of first rollers 135A (conveyance rollers). The first rollers 135A are conductive rubber rollers, which constitute ones of the above-described upper-discharge-roller pairs 135. The first roller shaft 135S runs in a sheet width direction (a front-rear direction) intersecting with the conveyance direction of the sheet P in the main body housing 503. The first roller shaft 135S is a conductive shaft, which is rotationally driven. The first rollers 135A are secured to the first roller shaft 135S, and conveys the sheet P so as to pass the upper discharge port 5A in accordance with a rotation of the first roller shaft 135S. With reference to FIG. 3, the upper discharge port 5A includes a plurality of second rollers 135B. The second rollers 135B constitute the other rollers of the upper discharge roller pair 135. The second rollers 135B are located below the respective first rollers 135A. The second rollers 135B are driven by the first roller 135A, so as to rotate.

With reference to FIG. 3, the lower discharge port 5B includes a plurality of third rollers 134B. The third rollers 134B constitute ones of rollers of the lower discharge roller pairs 134. While the other rollers, which constitute the lower discharge roller pairs 134 (see FIG. 1), are not illustrated in FIGS. 2 and 3, the main body housing 503 rotatably supports also the other rollers.

With reference to FIG. 3, the sheet discharge unit 5 further includes first actuators 511, a second actuator 512, third actuators 513, a fourth actuator 514, an upper-discharging brush 61, and a lower-discharging brush 62.

A pair of the first actuators 511 are located at both the end portions in a front-rear direction of the upper discharge port 5A. The main body housing 503 swingably supports the first actuators 511. The second actuator 512 is located at the center in the front-rear direction of the upper discharge port 5A. The main body housing 503 swingably supports also the second actuator 512. The first actuators 511 and the second actuator 512 detect a full-load state of the sheet P loaded on the sheet discharge tray 242 (see FIG. 1).

A pair of the third actuators 513 are similarly located at both the end portions in the front-rear direction of the lower discharge port 5B. The main body housing 503 swingably supports the third actuators 513. The fourth actuator 514 is located at the center in the front-rear direction of the lower discharge port 5B. The main body housing 503 swingably supports also the fourth actuator 514. The third actuators 513 and the fourth actuator 514 detect a full-load state of the sheet P loaded on the paper sheet discharge unit 241 (see FIG. 1).

The upper-discharging brush 61 is located at the upper discharge port 5A, and contacts the sheet P to discharge the sheet P. A plurality of the upper-discharging brushes 61 are arranged at intervals in the sheet width direction. The respective upper-discharging brushes 61 are made of a plurality of conductive brushes made of Stainless Steel (which is also referred to as SUS). The upper-discharging brush 61 constitutes a part of a discharging member 6 (described later). Similarly, the lower-discharging brush 62 is located at the lower discharge port 5B, and contacts the sheet P to discharge the sheet P.

With reference to FIG. 2, the sheet discharge unit 5 further includes a first guide 521, a second guide 522, and a third guide 523. The first guide 521 is a guiding member, which constitutes a part of the sheet conveyance path PP. The second guide 522 and the third guide 523, in addition to the first guide 521, constitute a duplex conveyance path DP (see FIG. 1), which conveys the sheet P when forming an image on the back side of the sheet P. The third guide 523 includes a duplex conveyance roller 523R, which conveys the sheet P in the duplex conveyance path DP.

Figure 4A:
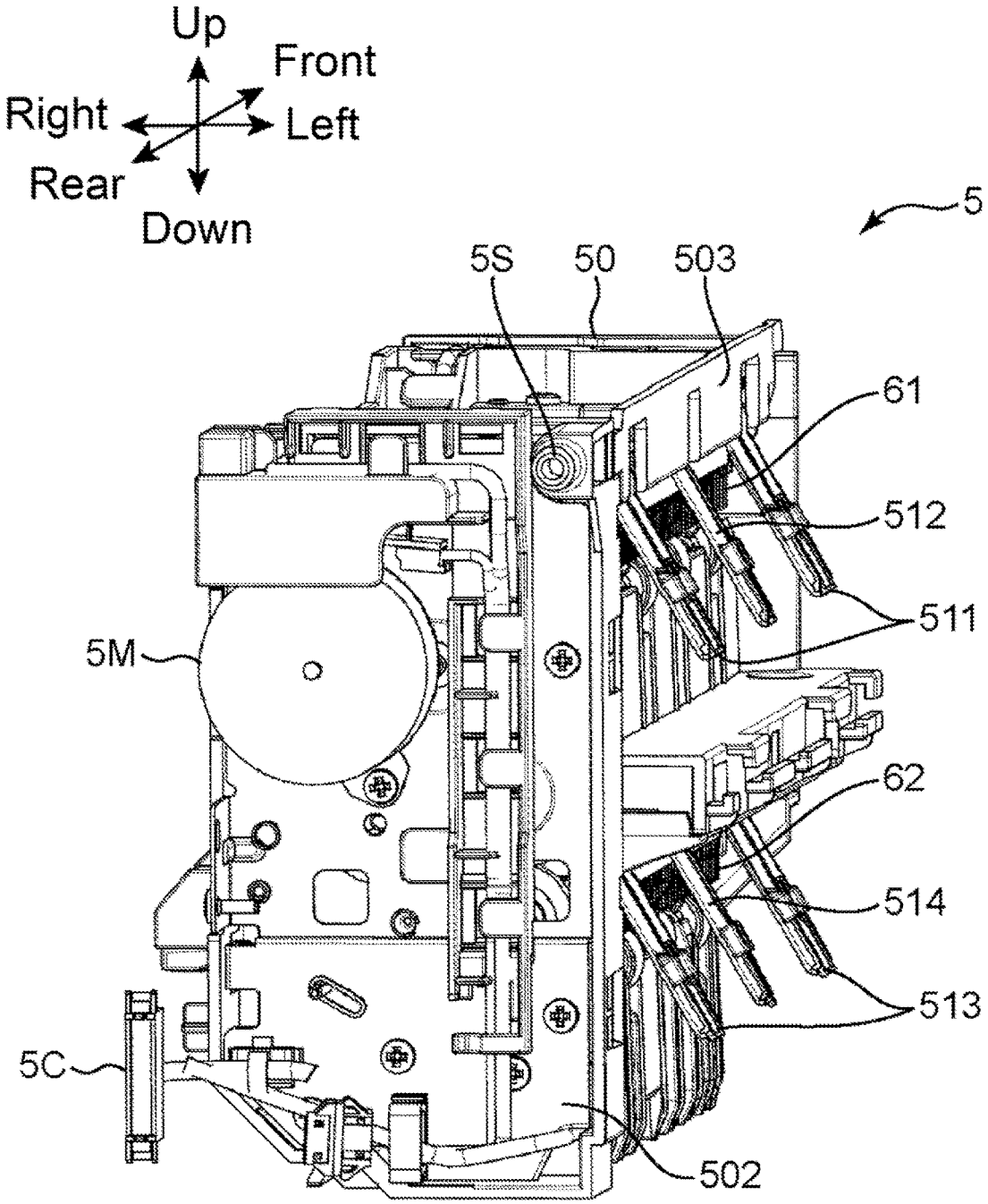
FIG. 4A obliquely illustrates the sheet conveyance apparatus according to the one embodiment.
Figure 4B:
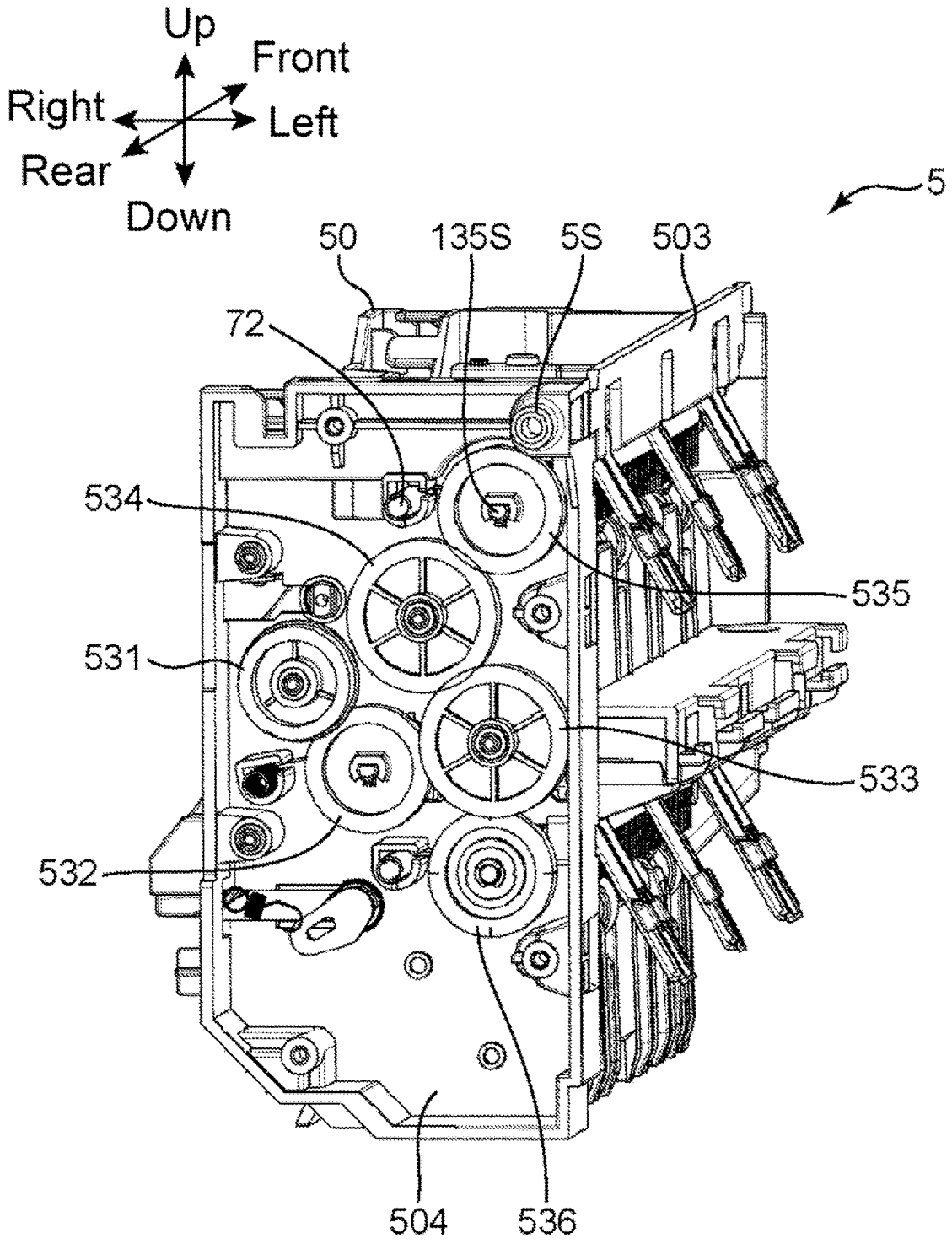
FIG. 4B obliquely illustrates the sheet conveyance apparatus according to the one embodiment.

FIGS. 4A to 4D obliquely illustrate the sheet discharge unit 5 from rear side. FIGS. 4A to 4D illustrate the sheet discharge unit 5 whose members are partially removed in sequence. FIG. 4A obliquely illustrates the sheet discharge unit 5 illustrated in FIG. 3 from a further rear side. When the above-described sheet-metal cover 502 is removed from the sheet discharge unit 5 illustrated in FIG. 4A, a plurality of gears and similar unit appear as illustrated in FIG. 4B. Specifically, the sheet discharge unit 5 includes an input gear 531, a first transmission gear 532, a second transmission gear 533, a third transmission gear 534, a fourth transmission gear 535, and a fifth transmission gear 536. These gears constitute a drive transmission unit of the disclosure. The drive transmission unit is included in the rear inner wall portion 504, and transmits a rotary drive power to the first roller shaft 135S. The input gear 531 is engaged with an output shaft (not illustrated) of the motor 5M. The first transmission gear 532 is engaged with the input gear 531 and the second transmission gear 533 to transmit a rotary drive power of the input gear 531 to the second transmission gear 533. The second transmission gear 533 is engaged with the third transmission gear 534 and the fifth transmission gear 536. The third transmission gear 534 is engaged with the fourth transmission gear 535. The fourth transmission gear 535 is a gear secured to the first roller shaft 135S. Similarly, the fifth transmission gear 536 is secured to a shaft of the roller constituting the lower discharge roller pair 134 (see FIG. 1). The above-described sheet-metal cover 502 has a function of covering the drive transmission unit including the plurality of the above-described gears.

Figure 4C:
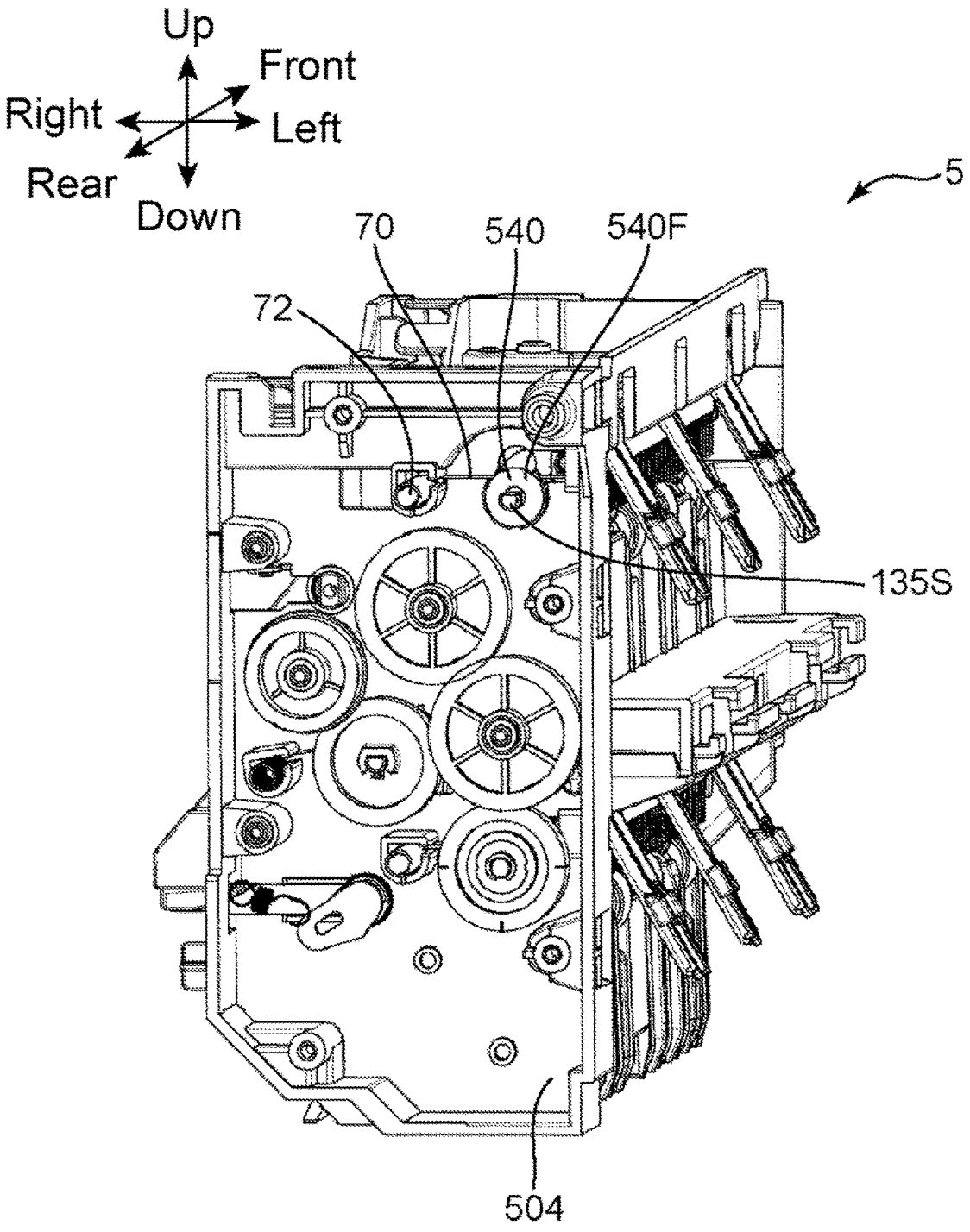
FIG. 4C obliquely illustrates the sheet conveyance apparatus according to the one embodiment.

After the fourth transmission gear 535 is removed from the sheet discharge unit 5 illustrated in FIG. 4B, a bearing 540 (a bearing member) is exposed as illustrated in FIG. 4C. The bearing 540 is installed at the rear inner wall portion 504, and rotatably supports a rear end portion of the first roller shaft 135S (one end side of the sheet width direction). The bearing 540 is made of a conductive material. The bearing 540 includes an outer peripheral surface and an inner circumference surface, and has a cylindrical shape. The bearing 540 has an inner circumference surface supporting the first roller shaft 135S. The bearing 540 has one end in an axial direction on which a flange 540F is disposed. Only the flange 540F of the bearing 540 appears in FIG. 4C.

Figure 4D:
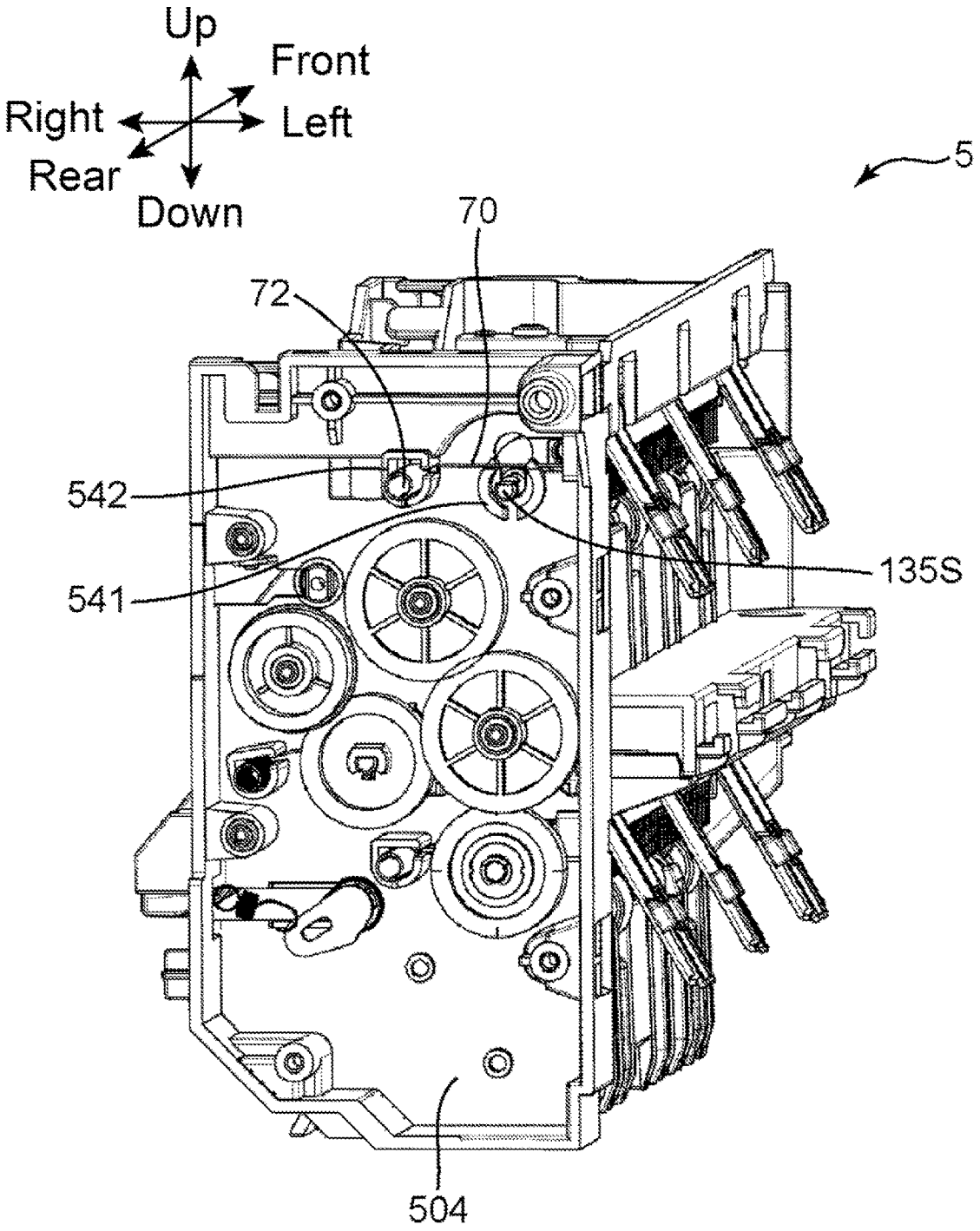
FIG. 4D obliquely illustrates the sheet conveyance apparatus according to the one embodiment.

After the bearing 540 is removed from the sheet discharge unit 5 illustrated in FIG. 4C, a bearing supporting portion 541 is exposed as illustrated in FIG. 4D. The bearing supporting portion 541 is a protrusion located projecting from a wall surface of the rear inner wall portion 504 to support the bearing 540. The bearing supporting portion 541 has a pair of arch shapes. After a cylindrical portion of the bearing 540 is installed at an inner peripheral portion of the bearing supporting portion 541, the flange 540F of the bearing 540 contacts a rear side surface of the bearing supporting portion 541 (see FIGS. 4C and 4D).

Figure 5:
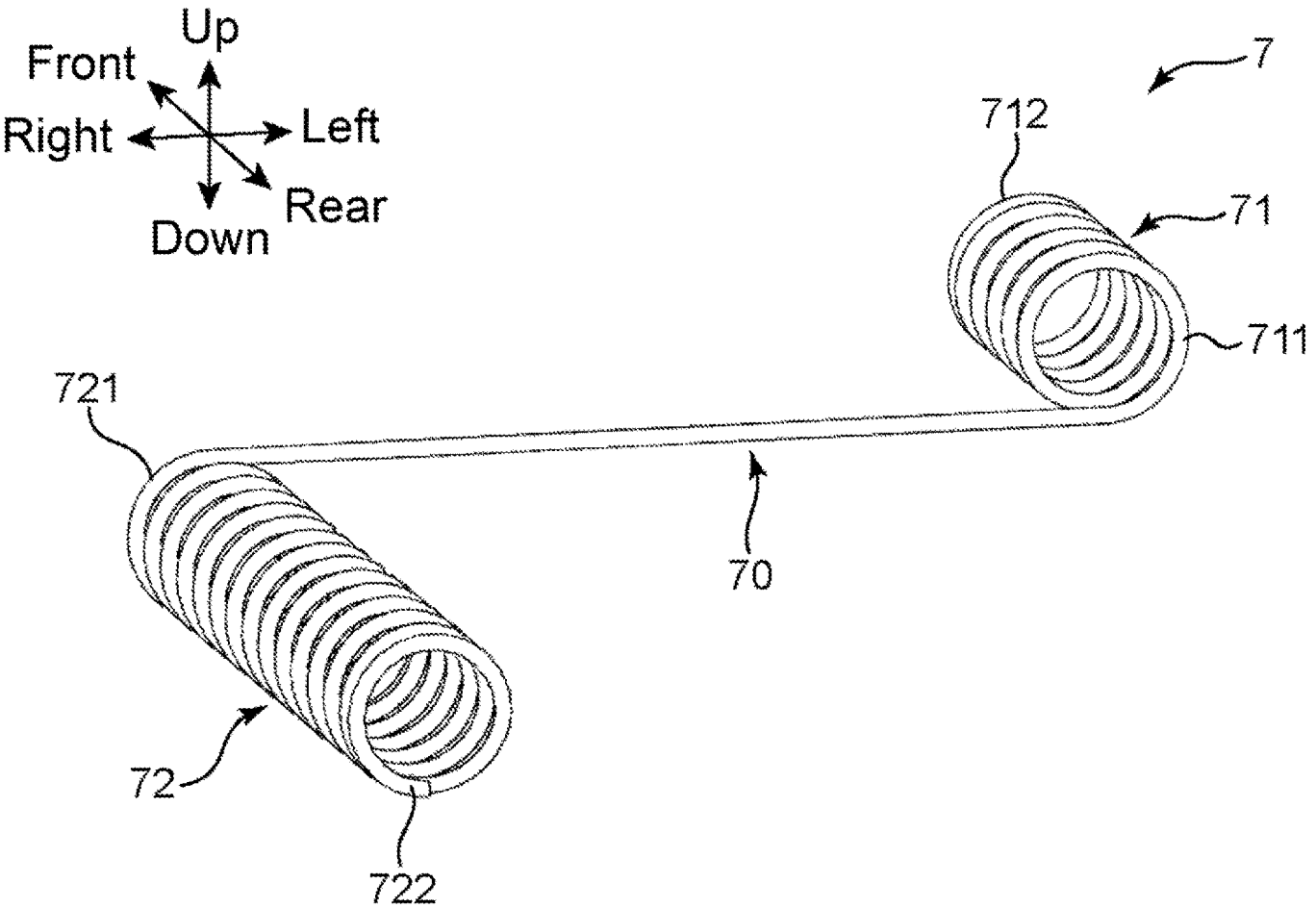
FIG. 5 obliquely illustrates a grounding member according to the one embodiment.
Figure 6:
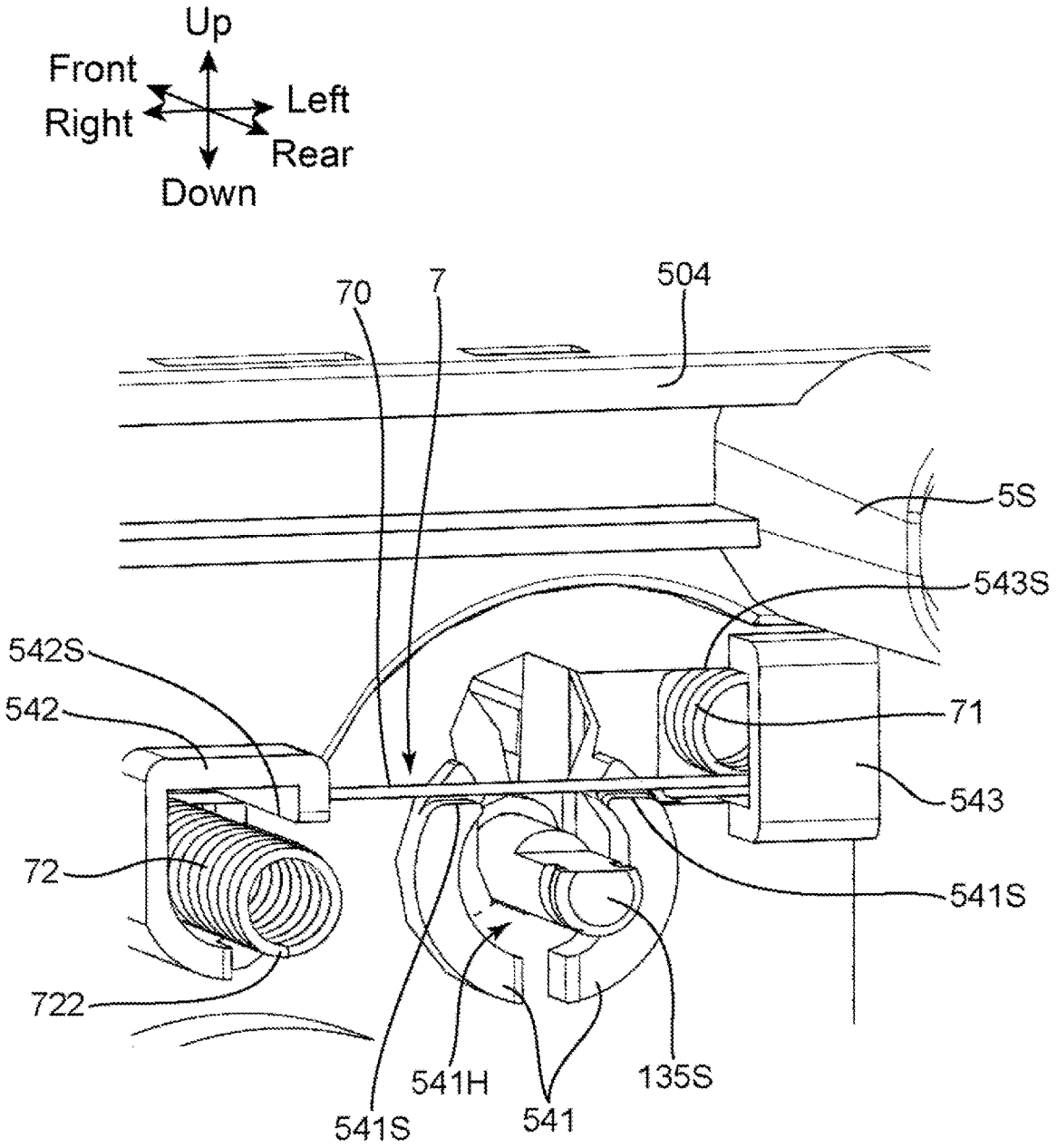
FIG. 6 obliquely illustrates an enlarged part of the sheet conveyance apparatus according to the one embodiment.

The sheet discharge unit 5 further includes a ground spring 7 (one example of a grounding member: see FIG. 5). FIG. 5 obliquely illustrates the ground spring 7 according to the embodiment. FIG. 6 obliquely illustrates an enlarged part of the sheet discharge unit 5 according to the embodiment. FIG. 6 illustrates an enlarged periphery of the first roller shaft 135S and the bearing supporting portion 541, which are illustrated in FIG. 4D, and illustrates a perspective view from a different point of view.

The ground spring 7 is installed at the rear inner wall portion 504 to abut on the bearing 540 (see FIG. 4C) and a rear end side of the discharging member 6 (one end side in the sheet width direction). The ground spring 7 has a function of conducting the bearing 540 and the discharging member 6 (see FIG. 7B) to the sheet metal cover 502. The ground spring 7 is made of a conductive spring member. Specifically, the ground spring 7 includes a center wire 70 (a line-shaped portion), a first coil 71, and a second coil 72. In the embodiment, the ground spring 7 is formed by bending one metallic linear member (a wire). This causes a constitution of the ground spring 7 at saved cost compared with a case where the ground spring 7 is constituted of a plurality of components.

The center wire 70 is arranged extending in a lateral direction. In the embodiment, the center wire 70 extends along the conveyance direction of the sheet P discharged from the upper discharge port 5A. The first coil 71 is a coil portion, which is compressible and deformable, and runs toward a front direction (the sheet width direction) from a left side end (one end) of the center wire 70. The first coil 71 includes a first coil base end portion 711 and a first coil conduction portion 712. The first coil conduction portion 712 is a distal end portion of the first coil 71. The second coil 72 is a coil portion, which is compressible and deformable, and runs toward a rear direction (an opposite side to the first coil 71 in the sheet width direction) from a right end (the other end) of the center wire 70. The second coil 72 includes a second coil base end portion 721 and a second coil conduction portion 722. The second coil conduction portion 722 is a distal end portion of the second coil 72.

With reference to FIG. 6, the rear inner wall portion 504 includes a first coil housing portion 543 (a first coil supporting unit) in addition to the above-described bearing-supporting portion 541 and second coil housing portion 542.

Upper end portions of the pair of the arch-shaped bearing supporting portions 541 each include a cutout portion 541S. The cutout portion 541S is a region, where the upper end portion of the bearing supporting portion 541 is partially and horizontally cut out. The cutout portion 541S is formed to avoid contact between the bearing supporting portion 541 and the center wire 70 of the ground spring 7 (see FIG. 6). In a peripheral area of the first roller shaft 135S and between the pair of the bearing supporting portions 541, there is formed a bearing insertion portion 541H for inserting the bearing 540.

The second coil housing portion 542 is a cylindrically-shaped portion located projecting rearward at a right side of the bearing supporting portion 541. The second coil 72 of the ground spring 7 is located in the second coil housing portion 542. As described below, the second coil housing portion 542 has a left side surface, which is partially opened, and this causes the second coil housing portion 542 to house the second coil 72 (see FIG. 6). The second coil housing portion 542 includes a second coil supporting unit 542H (see FIG. 8C). The second coil supporting unit 542H supports the second coil base end portion 721 of the second coil 72.

The first coil housing portion 543 is, in a sectional view, a U-shaped wall portion located upright at a left side of the bearing supporting portion 541. The first coil housing portion 543 supports the first coil base end portion 711 of the first coil 71 (see FIG. 5). As described below, the first coil housing portion 543 houses the first coil 71, and this ensures an opening at a right side of the first coil housing portion 543 (see FIG. 6). The first coil housing portion 543 has a front side (a back side) surface opposed to the discharging member 6 (described later).

Figure 7A:
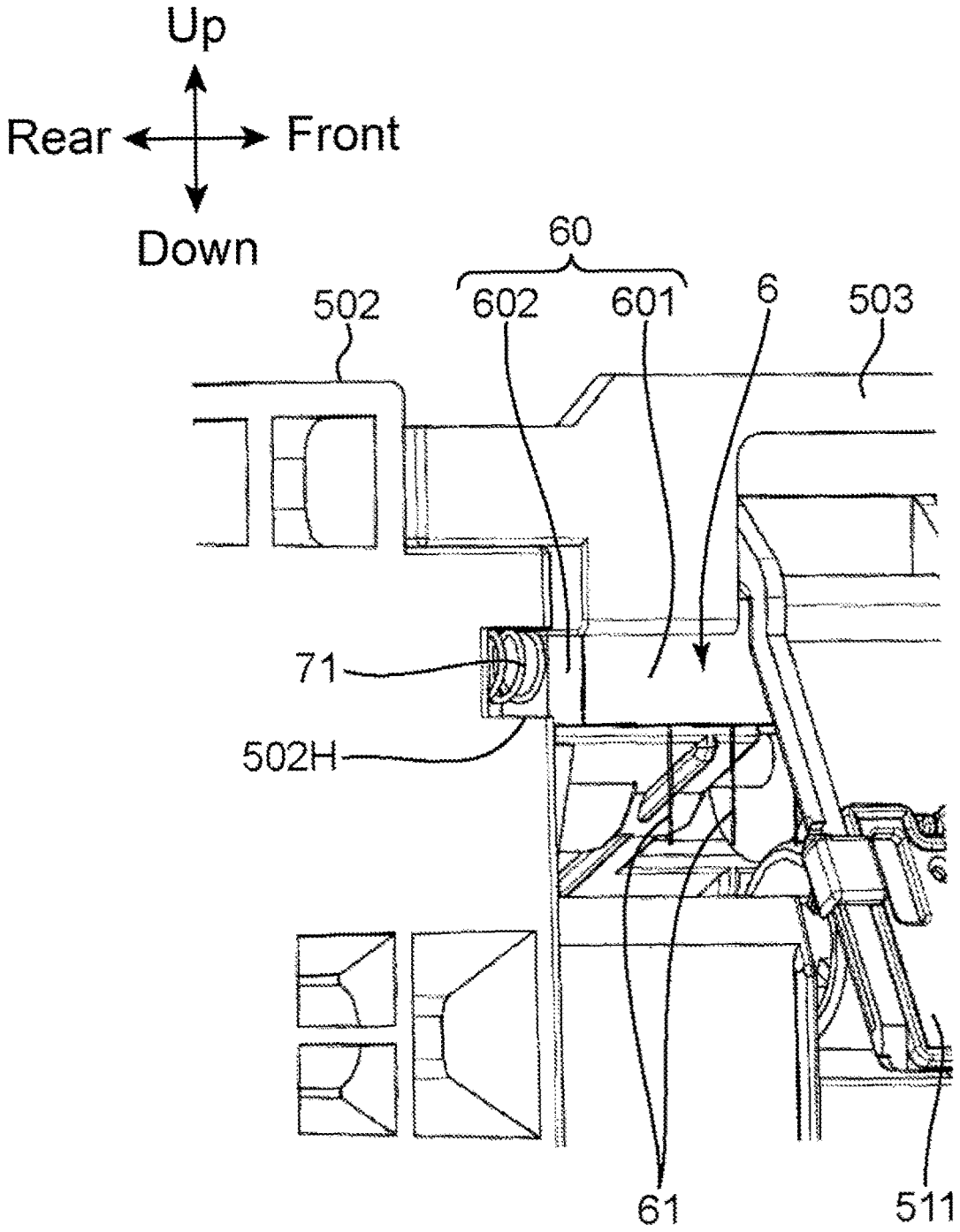
FIG. 7A obliquely illustrates an enlarged part of the sheet conveyance apparatus according to the one embodiment.
Figure 7B:
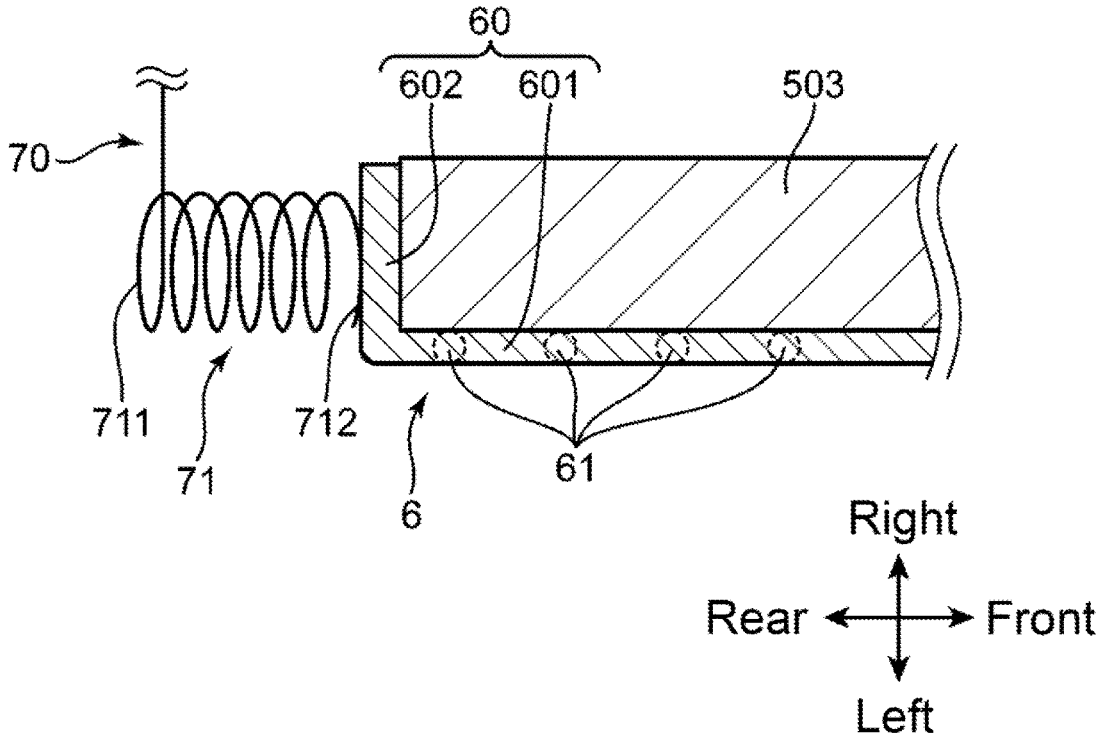
FIG. 7B illustrates an enlarged cross-section of a grounding route of an discharging member according to the one embodiment.
Figure 8A:
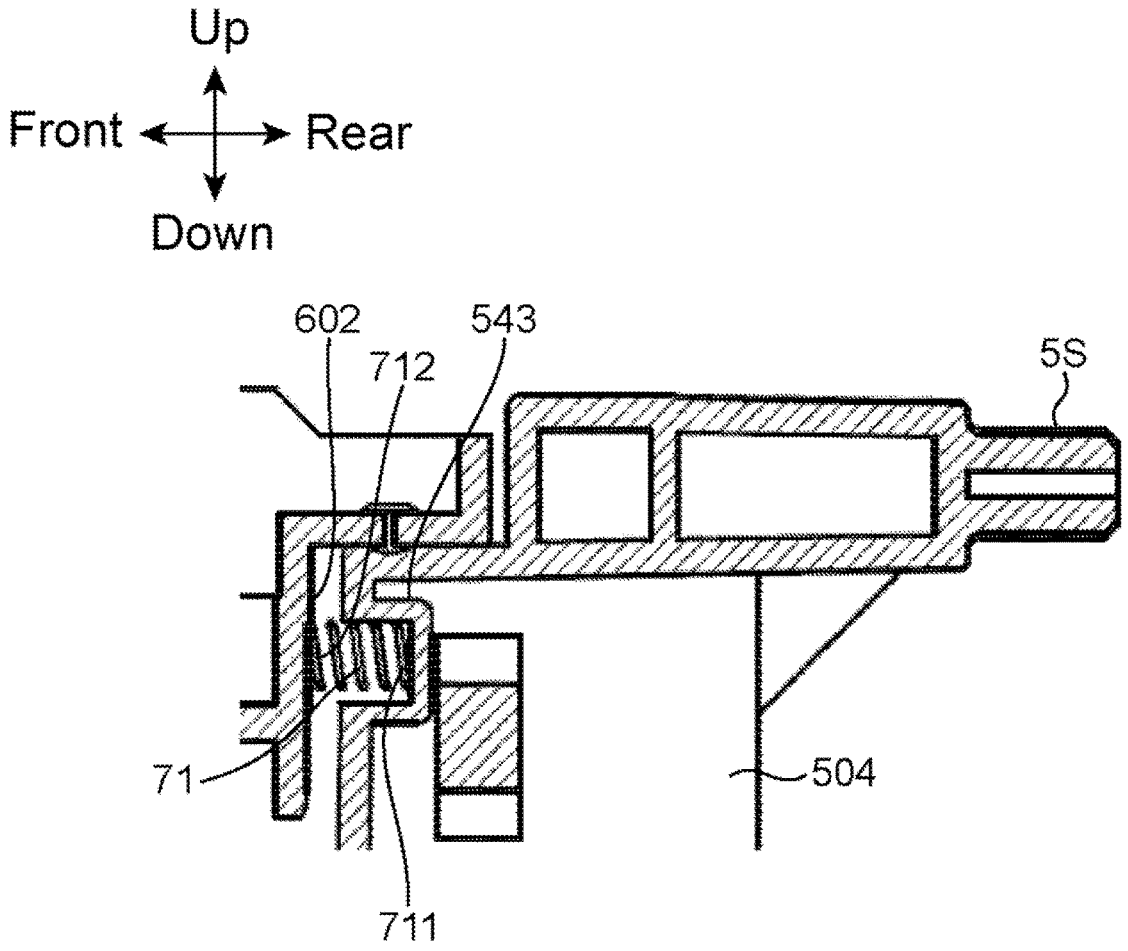
FIG. 8A illustrates an enlarged cross section of a part of the sheet conveyance apparatus according to the one embodiment.
Figure 8B:
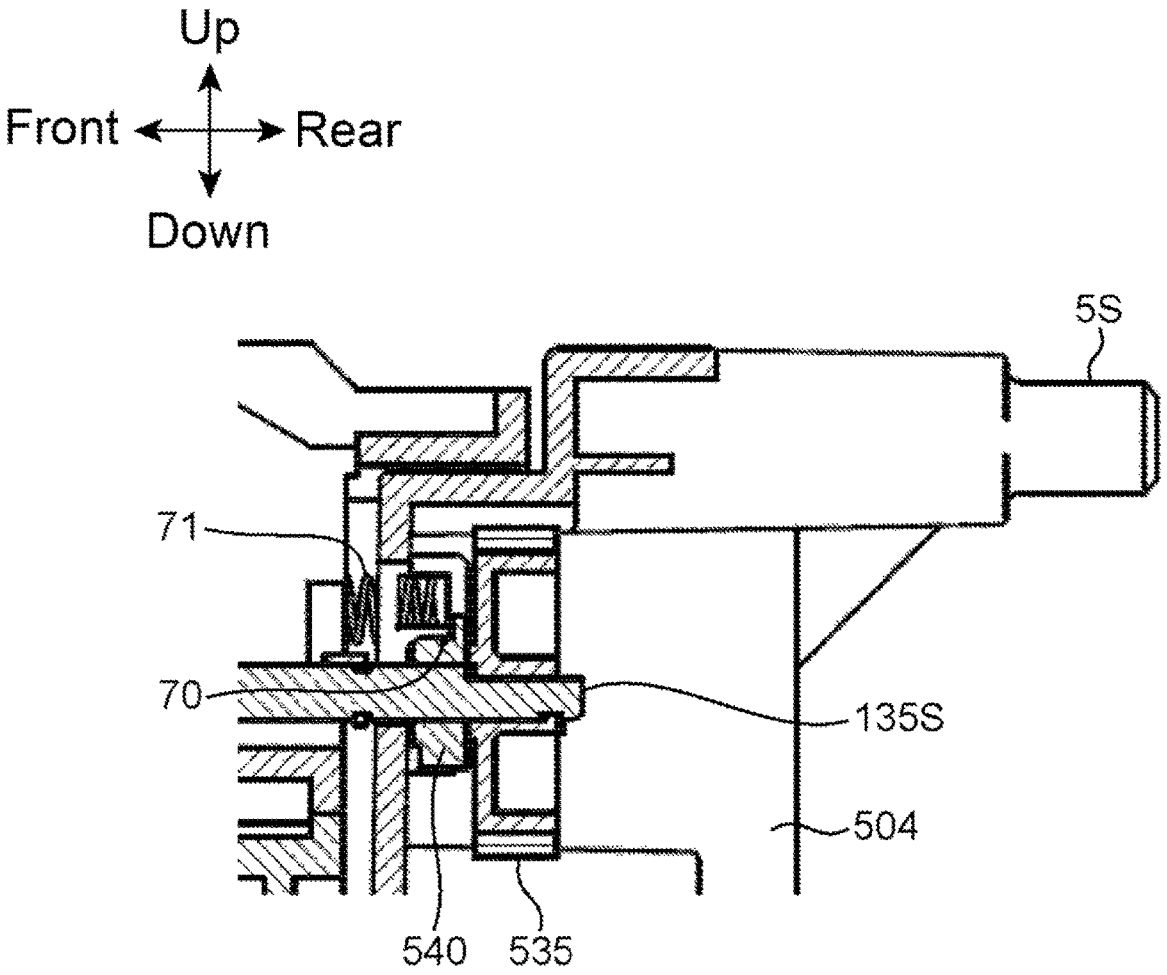
FIG. 8B illustrates an enlarged cross section of a part of the sheet conveyance apparatus according to the one embodiment.
Figure 8C:
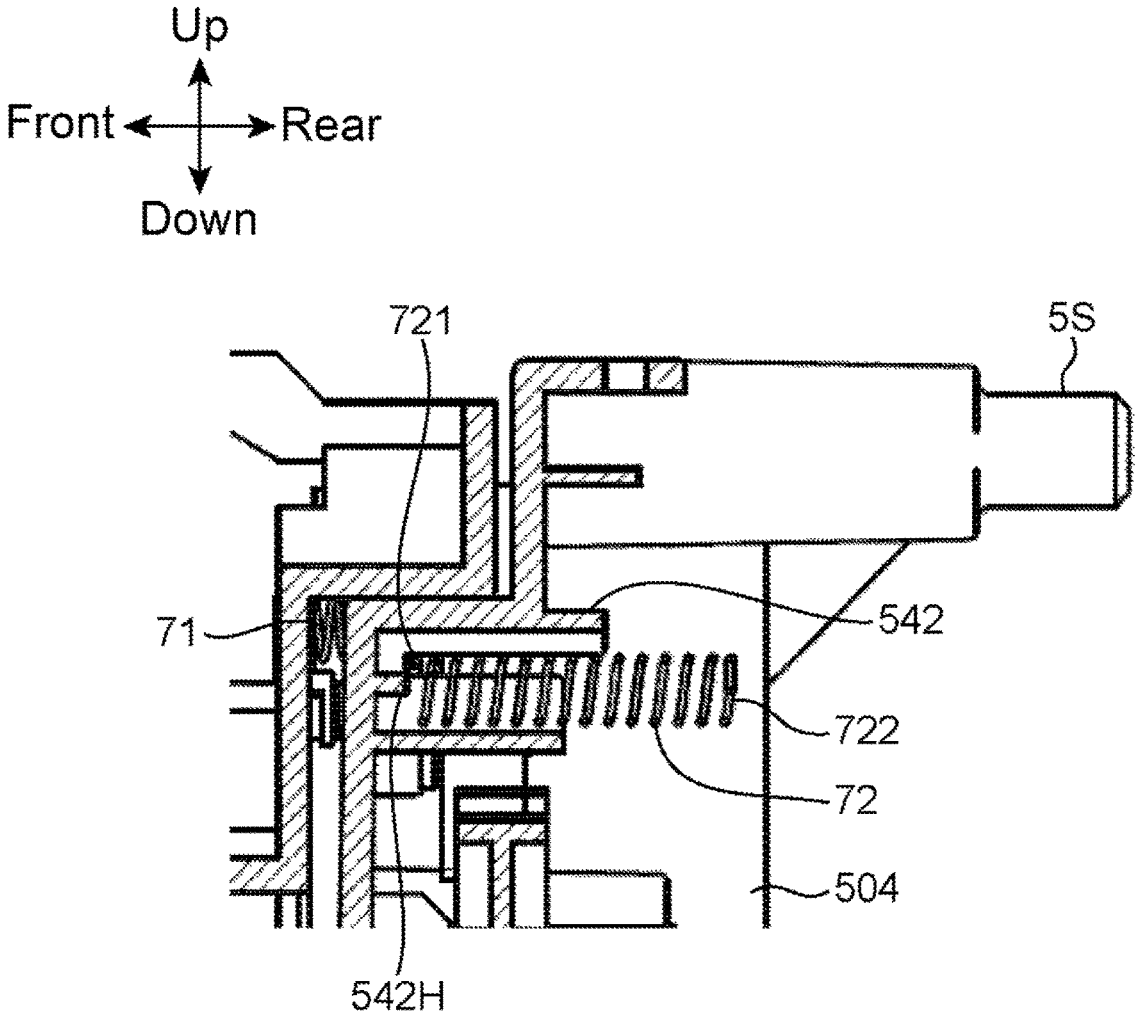
FIG. 8C illustrates an enlarged cross section of a part of the sheet conveyance apparatus according to the one embodiment.

FIG. 7A obliquely illustrates an enlarged part of the sheet discharge unit 5 according to the embodiment. FIG. 7B illustrates an enlarged cross-sectional view illustrating a grounding route of the discharging member 6 according to the embodiment. FIGS. 8A to 8C illustrate enlarged cross sections of a part of the sheet discharge unit 5 according to the embodiment.

With reference to FIG. 7A, the sheet discharge unit 5 includes a conductive discharging member 6. The discharging member 6 extends in the front-rear direction and is located immediately above the upper discharge port 5A. The discharging member 6 includes a brush supporting unit 60 and the above-described upper-discharging brush 61. The brush supporting unit 60 is a member that supports the upper-discharging brush 61. The brush supporting unit 60 is made of an aluminum plate-shaped member. The brush supporting unit 60 includes a supporting unit 601 (a base portion) and a conduction portion 602 (a bending portion). The supporting unit 601 extends in the front-rear direction, and is secured to the main body housing 503. Then, the above-described upper-discharging brush 61 (discharging brush) is arranged at intervals in the front-rear direction, and is supported by the supporting unit 601. The upper-discharging brush 61 is arranged extending downward from the supporting unit 601, this ensures a swingable-upper-discharging brush 61, and reduces an excessive load on the sheet P.

The conduction portion 602 is formed by bending a rear end of the supporting unit 601 (one end side in the front-rear direction). In the embodiment, the conduction portion 602 is orthogonally arranged to the supporting unit 601 (see FIG. 7B). The conduction portion 602 is arranged opposed to the first coil housing portion 543 in the front-rear direction (see FIG. 6). The lower discharge port 5B includes a member similar to the discharging member 6. The discharging member includes the above-described lower-discharging brush 62.

The ground spring 7 is installed first at the rear inner wall portion 504 in a state where the bearing 540 is not installed at the rear inner wall portion 504 as illustrated in FIGS. 4D and 6. A worker, first, inserts the first coil 71 of the ground spring 7 into the first coil housing portion 543 illustrated in FIG. 6. In this case, the first coil base end portion 711 of the first coil 71 contacts a wall surface of the first coil housing portion 543 (see FIG. 8A). Then, the first coil conduction portion 712 of the first coil 71 contact the conduction portion 602 of the discharging member 6 (see FIGS. 7A and 7B) in a state where the first coil 71 is compressed and deformed. Especially, the conduction portion 602, which is bent opposed to the first coil housing portion 543, has a predetermined area, and then this causes the first coil conduction portion 712 to stably abut on the conduction portion 602. As a result, the upper-discharging brush 61 of the discharging member 6 and reliably conducts to the first coil 71 of the ground spring 7.

After that, the worker arranges the center wire 70 of the ground spring 7 above the pair of cutout portions 541S (see FIG. 6), and houses the second coil 72 in the second coil housing portion 542. Then, the second coil base end portion 721 of the second coil 72 contacts the second coil supporting unit 542H of the second coil housing portion 542 (see FIG. 8C). In this case, as illustrated in FIGS. 6 and 8C, the second coil conduction portion 722 of the second coil 72 is exposed to a rear side of the rear inner wall portion 504.

Next, the worker installs the bearing 540 into the bearing insertion portion 541H of the rear inner wall portion 504 (see FIG. 6). At this time, the bearing 540 pivotally supports the first roller shaft 135S, and then the outer peripheral surface of a cylindrical portion of the bearing 540 slightly presses up the center wire 70 of the ground spring 7. As a result, the center wire 70 contacts the outer peripheral surface of the bearing 540 from an outside in a radial direction in a state where the center wire 70 extends approximately in a tangent line direction of the bearing 540. The center wire 70 abutting on the bearing 540, in practice, is bent, and slightly intersects with the above-described tangent-line direction. Then, the first roller shaft 135S conducts to the center wire 70 via a conductive bearing 540 (see FIG. 8B). After the bearing 540 is installed, the first coil 71 becomes to have an outer peripheral surface whose an upper end portion abuts on a contact surface 543S. A portion at a side of the second coil 72 in the center wire 70 contacts a contact surface 542S. This stably maintains a position of the ground spring 7.

After the bearing 540 is installed at the rear inner wall portion 504, respective gears including the fourth transmission gear 535 are installed at the rear inner wall portion 504 (see FIG. 4B). This covers the above-described respective gears, and then the sheet metal cover 502 is installed to cover the rear inner wall portion 504 (see FIG. 4A). At this time, the metallic sheet metal cover 502 has a side surface, which presses the second coil conduction portion 722 of the second coil 72, thus compressing and deforming the second coil 72. The second coil 72 and the sheet metal cover 502 consequently conduct one another. Then, after the sheet discharge unit 5 is installed at the connection chassis 23 of the main chassis 2, the sheet metal cover 502 contacts a contact piece (not illustrated) located at the connection chassis 23. As a result, the sheet metal cover 502 is grounded via the connection chassis 23, which is preliminarily grounded.

As described above, in the embodiment, one ground spring 7 included in one end of the main body housing 503 conducts the bearing 540 and the discharging member 6, which are located at positions separated one another, to a grounding portion of the sheet metal cover 502. This achieves the ground of the discharging member 6 and the upper discharge roller pair 135 with a simple configuration. It is not necessary that the whole unit housing 50 is made of a conductive material such as metal. Thus, the sheet discharge unit 5 is constituted at save cost.

In the embodiment, the discharging member 6 is secured to the main body housing 503 from a left side of the sheet discharge unit 5. On the other hand, the ground spring 7 is installed at the rear inner wall portion 504 of the main body housing 503 from a rear of the sheet discharge unit 5. Thus, the discharging member 6 and the ground spring 7 are independently removably attachable to the main body housing 503. This ensures the improved assemblability and maintainability of the sheet discharge unit 5.

In the embodiment, use of elastic forces of the first coil 71 and the second coil 72 causes the bearing 540 and the discharging member 6 to reliably conduct to the grounding portion of the sheet metal cover 502. The first coil 71 and the second coil 72 extend from the center wire 70 in opposite directions in the front-rear direction. This reduces the excessive reactive force applied to the main body housing 503. The rear inner wall portion 504 includes the first coil housing portion 543 and the second coil housing portion 542. This reduces the reactive forces of the first coil 71 and the second coil 72 applied to the bearing 540.

The center wire 70 of the ground spring 7 contacts the outer peripheral surface of the bearing 540 from the outside in the radial direction in a state where the center wire 70 extends in the tangent line direction of the bearing 540 (see FIGS. 6 and 8B). This reduces the force in the front-rear direction (the sheet width direction) applied to the bearing 540 from the center wire 70 of the ground spring 7, and then consequently ensures the reduced position changes of the first roller shaft 135S and the upper discharge roller pair 135 in the axial direction due to the grounding.

The embodiment further ensures the independent adjustments of a ground contact pressure between the ground spring 7 and the discharging member 6, a ground contact pressure between the ground spring 7 and the bearing 540, and a ground contact pressure between the ground spring 7 and the sheet metal cover 502. This consequently achieves appropriate grounding of the sheet discharge unit 5.

While the above has described the sheet discharge unit 5 according to the embodiment of the disclosure, and the image forming apparatus 1 including the sheet discharge unit 5, the disclosure is not limited to the above embodiment. The disclosure may include, for example, the following modified embodiments.

(1) While in the aspect of the above-described embodiment the whole sheet metal cover 502 is made of a metallic material and has conductivity, the disclosure is not limited to this aspect. A cover made of resin material may be installed at the rear inner wall portion 504 instead of the sheet metal cover 502. In this case, the cover includes a grounding portion abutting on the second coil conduction portion 722 of the ground spring 7. The grounding portion is grounded via a conductive path (not illustrated) in the main chassis 2 (see FIG. 1).

(2) While in the aspect of the above-described the embodiment the discharging member 6 includes the upper-discharging brush 61, the disclosure is not limited to this aspect. The discharging member 6 may have another shape insofar as the discharging member 6 contacts the sheet P to discharge the sheet P.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A sheet conveyance apparatus comprising:

a housing including an opening through which sheet conveyed in a predetermined direction pass, and a pair of sidewalls, the housing being made of a resin material, the sidewalls being located at both end portions of the housing in the sheet width direction intersecting with a conveyance direction of the sheet;

a rotationally driven conductive shaft extending in the sheet width direction in the housing;

a conveyance roller secured to the shaft, the conveyance roller rotating to convey sheets so as to pass through the opening in association with the shaft rotating;

a drive transmission unit provided on one of the pair of sidewalls along one end side in the sheet width direction, the drive transmission unit transmitting rotary drive power to the shaft;

a conductive bearing member installed in the housing, the bearing member rotatably supporting the one end side of the shaft in the sheet width direction;

a conductive discharging member disposed in the opening, the discharging member discharging sheet by contacting the sheet;

a cover member secured to the one of the pair of sidewalls along the one end side of the housing in the sheet width direction, the cover member covering the drive transmission unit, the cover member including a conductive grounding portion for electrical grounding; and a conductive grounding member contacting the bearing member and the one end side of the discharging member along the sheet width direction, the grounding member conducting the bearing member and the discharging member to the grounding portion of the cover member.

2. The sheet conveyance apparatus according to claim 1, wherein:

the grounding member includes a linear portion extending along the sheet conveyance direction, a first coil being compressible and deformable and extending in the sheet width direction from one end of the linear portion, and a second coil being compressible and deformable and extending in the sheet width direction from another end of the linear portion, the second coil extending in an direction opposite to the first coil extending direction; and the one of the pair of sidewalls at the one end side of the housing includes a first coil supporting unit supporting a base end portion of the first coil, and a second coil supporting unit supporting a base end portion of the second coil; wherein a tip end portion of the first coil contacts the one end side of the discharging member in a state where the first coil is compressed and deformed, a tip end portion of the second coil contacts the grounding portion of the cover member in a state where the second coil is compressed and deformed, and the linear portion contacts the bearing member.

3. The sheet conveyance apparatus according to claim 2, wherein:

the bearing member has a cylindrical shape, and includes an outer peripheral surface, and an inner circumference surface supporting the shaft; and the linear portion contacts the outer peripheral surface from its radially outer side, in a state where the linear portion extends approximately in a tangent line direction of the outer peripheral surface of the bearing member.

4. The sheet conveyance apparatus according to claim 2, wherein the linear portion, the first coil, and the second coil are constituted of a single linear element.

5. The sheet conveyance apparatus according to claim 3, wherein the linear portion contacting the bearing member is bent so as to slightly intersect with the tangent line direction.

6. The sheet conveyance apparatus according to claim 2, wherein:

the one of the pair of sidewalls at the one end side of the housing includes a bearing supporting portion, the bearing supporting portion located projecting from a wall surface of the one of the pair of sidewalls to support the bearing member; and the bearing supporting portion includes an upper end portion having a cutout portion formed by cutting out partially and horizontally.

7. The sheet conveyance apparatus according to claim 2, wherein:

the discharging member includes a base portion secured to the housing to extend in the sheet width direction, a bending portion being bent one end side of the base portion along the sheet width direction, and a plurality of discharging brushes arranged at intervals in the sheet width direction, the plurality of discharging brushes being supported by the base portion; and the tip end portion of the first coil contacts the bending portion.

8. An image forming apparatus comprising:

an image forming unit that forms an image on a sheet; and the sheet conveyance apparatus according to claim 1.

* * * * *